United States Patent [19]

Ruskin et al.

[11] 3,933,296

[45] Jan. 20, 1976

[54] PACKAGING CONTAINERS

[75] Inventors: Bryan Ernest Sydney Ruskin, St. Albans; Peter James Webber, Leverstock Green, both of England

[73] Assignee: Lunch Locker Systems Limited, St. Albans, England

[22] Filed: Mar. 5, 1974

[21] Appl. No.: 448,183

[30] Foreign Application Priority Data

| | | |
|---|---|---|
| Mar. 9, 1973 | United Kingdom | 11453/73 |
| Apr. 14, 1973 | United Kingdom | 18071/73 |
| Apr. 25, 1973 | United Kingdom | 19572/73 |
| May 9, 1973 | United Kingdom | 22135/73 |
| Nov. 24, 1973 | United Kingdom | 54641/73 |

[52] U.S. Cl. ..... 229/2.5; 229/29 M; 220/31 S; 312/7; 229/15

[51] Int. Cl.[2] ..... B65D 1/00; B65D 43/10

[58] Field of Search ..... 220/31 S; 229/2.5:29 M, 229/15; 312/7

[56] References Cited

UNITED STATES PATENTS

| | | | |
|---|---|---|---|
| 3,295,737 | 1/1967 | Page et al. | 229/2.5 |
| 3,342,397 | 9/1967 | Duitsman | 229/2.5 |
| 3,351,270 | 11/1967 | Hohnjec | 229/2.5 X |
| 3,381,873 | 5/1968 | Hirota | 229/2.5 |
| 3,552,595 | 1/1971 | Gerner | 220/31 X |
| 3,567,013 | 3/1971 | Tannenbaum | 229/2.5 X |
| 3,580,650 | 5/1971 | Morris | 312/7 |

*Primary Examiner*—Davis T. Moorhead
*Attorney, Agent, or Firm*—Fleit & Jacobson

[57] ABSTRACT

A packaging container formed from sheet material such as plastics comprising a rectangular body having lid portions hinged along opposed edges the body and lid portions each containing at least one storage compartment and cover portions hinged to the lid portions. The cover portions are folded over and attached to the lid portions which, in turn, are folded over and attached to the body. A compact closed container is thus formed with a number of separated compartments and when open, the container presents a tray-like configuration.

6 Claims, 9 Drawing Figures

PACKAGING CONTAINERS

Figure 1:
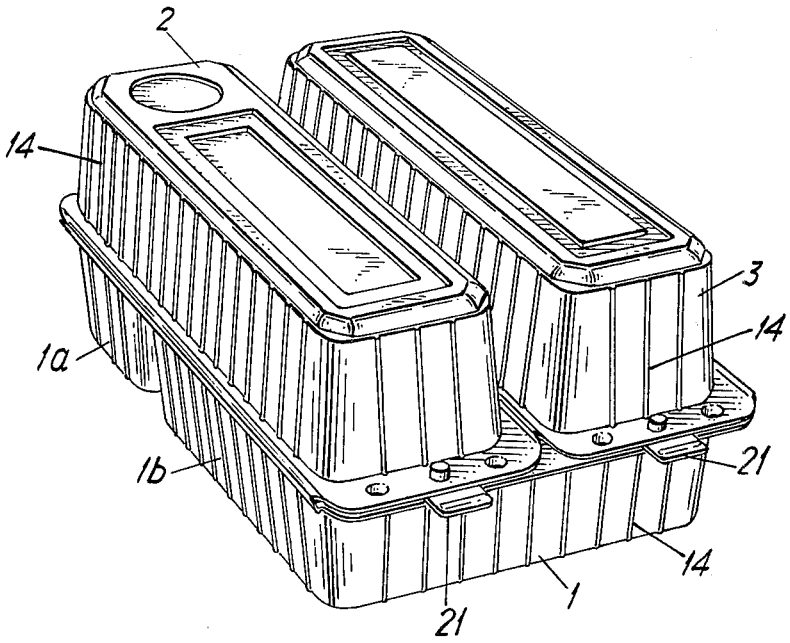

This invention relates to a packaging container, particularly, though not exclusively, intended for the storage and serving of meals.

It is an object of the present invention to provide a packaging container as aforesaid in which a plurality of courses or parts of courses of a meal can conveniently be packed, stored and transported and from which a said meal can conveniently be consumed.

According to a first aspect of the present invention, a packaging container has a body at least one lid portion pivotably hinged thereto and a cover portion pivotally hinged to the lid portion, the body and said at least one lid portion each defining at least one storage compartment, the said storage compartments being mutually separated by the cover portion when the cover portion is pivoted into a first position in which it is folded over and closes the lid portion and the latter, in turn, is pivoted to a first position in which it is folded over and closes the container, and the said storage compartments being exposed in substantially the same plane, so that the container presents a tray-like configuration, when the lid and cover portions are each pivoted into second open positions.

Preferably, two lid portions, each with a cover portion, are provided along opposed edges of a body of rectangular form in plan.

Conveniently, at least two storage compartments are provided in the body separated by a wall which extends normal to the line of the hinge for the lid portion(s), the arrangement being such that, with the cover and lid portions in their folded over first positions, the upper edge of the wall acts to support the cover portion(s) against the weight of any contents in the storage compartment of the lid portion(s).

The container may be formed relatively cheaply by moulding or pressing a thin sheet material such as plastics, cardboard, or paper; the inner surface of the cardboard or paper may be suitably treated for containing the meal. Such a container may therefore be thrown away after use.

Alternatively, the container may be sturdily constructed of plastics or other suitable material so as to be durable for repeated use, for example, for picnics.

According to a feature of this invention, locking or attachment means are provided for attaching said lid portion in its folded over first portion, comprising connectable male and female elements at co-incident positions on the body and lid portions.

The cover portion may also be attached to the lid portion in its folded over first position, in which case, connectable male and female elements may also be provided at co-incident positions on the cover and lid portions; these latter elements may be sited such that those for the two sets of locking means in the lid portion are at offset positions.

In a preferred form the co-operable male and female elements are of generally circular cross-section, the female elements being of somewhat smaller diameter than the male element, and the wall of the male element having a pair of flats at substantially diametrically opposite positions.

According to another feature of this invention, at least one of the storage compartments of the container has a removable insert associated therewith, the insert being of smaller dimensions than its compartment and having a flange adapted to locate around the mouth of the compartment, and a raised boss or the like being provided on the container or insert, whereby the latter may seat onto the bottom of the compartment and thereby be supported in the compartment with a surrounding air gap.

According to a further feature of this invention the hinge between each lid portion and body, as well as its cover portions, each comprise a pair of closely spaced substantially parallel indentations or grooves formed in the container, the adjacent walls of the grooves being inclined towards each other.

According to a second aspect of this invention, a kit is provided comprising a plurality of containers according to the first aspect of this invention, and the same number of trays, each having a marginal upstanding wall and being of sufficient dimensions to provide a base for snugly retaining one open container within the marginal wall, or two closed containers side by side.

Figure 2:
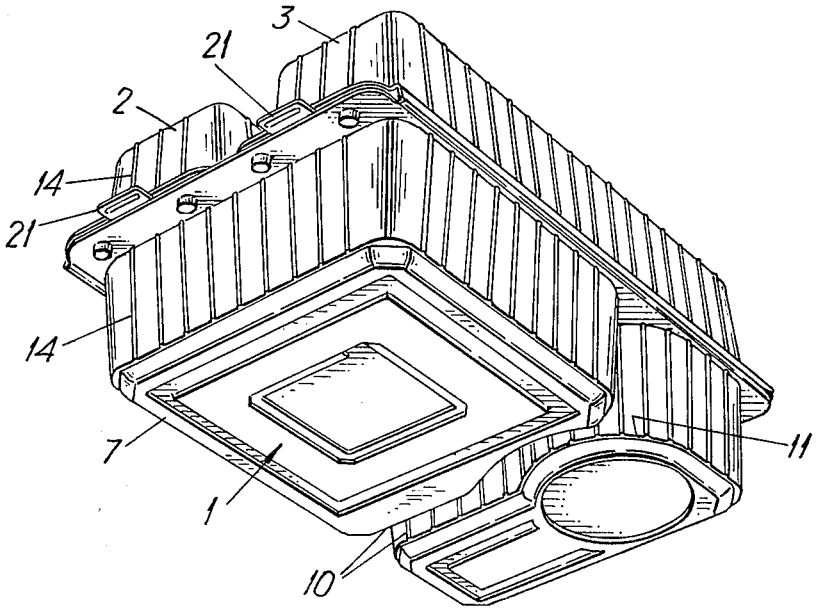
Figure 3:
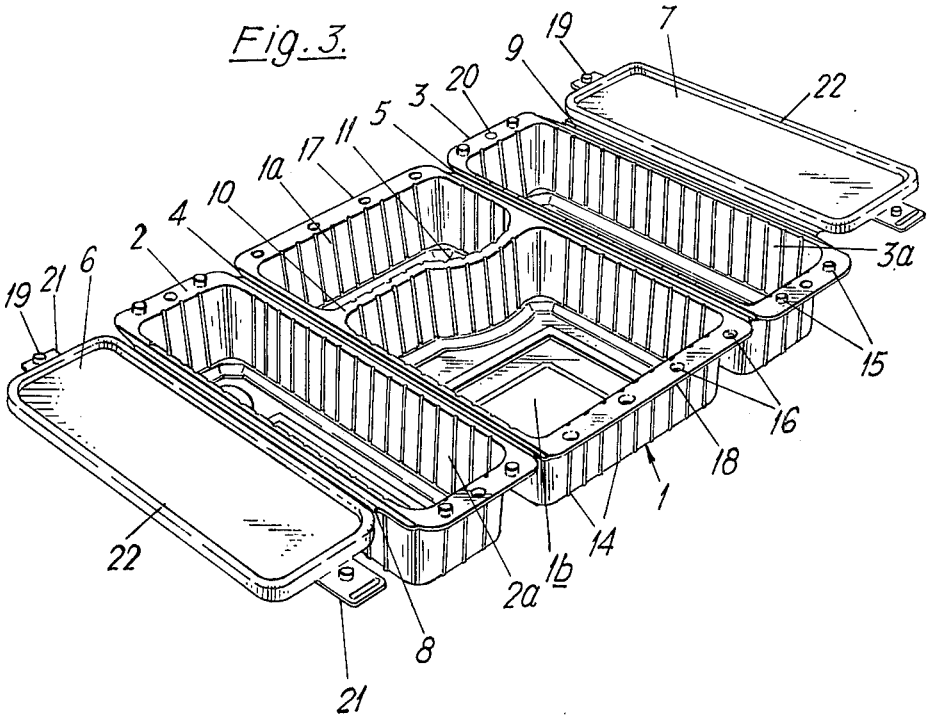
Figure 4A:
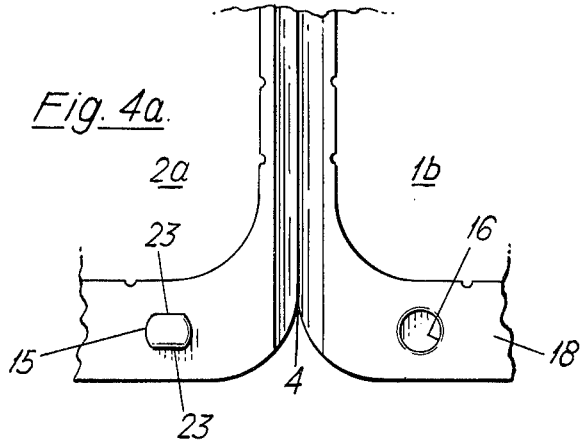
Figure 4B:
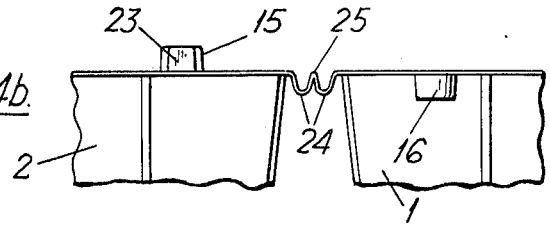
Figure 5:
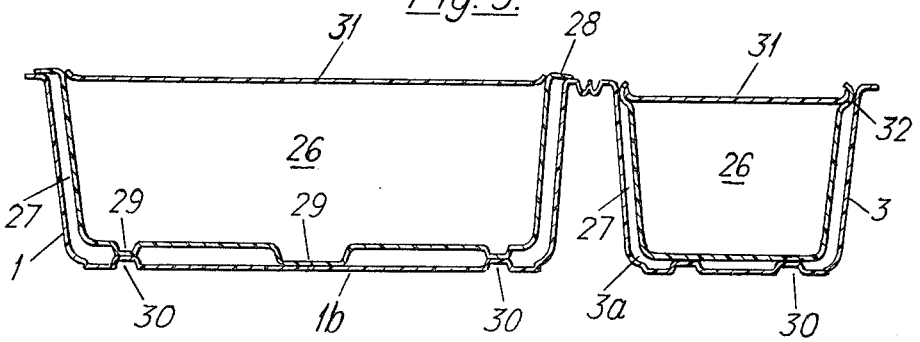
Figure 6A:
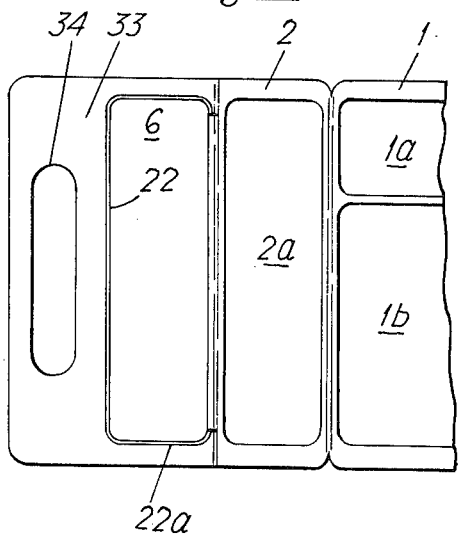
Figure 6B:
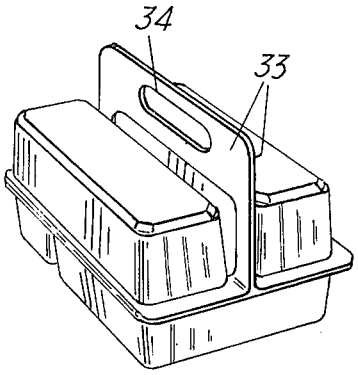
Figure 7:
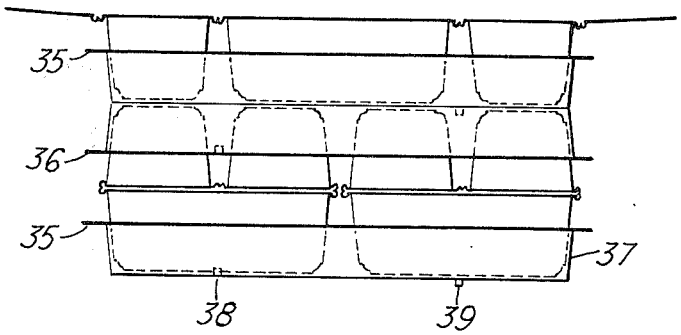

In order that the invention may be readily understood and further features made apparent, one embodiment thereof of packaging container in accordance therewith, and modifications thereof, will now be described, by way of example, with reference to the accompanying drawings, in which:

FIG. 1 is a perspective view from above of the container in its closed condition, FIG. 2 is a perspective view from below of the closed container, FIG. 3 is a perspective view from above of the container in its open condition, FIGS. 4*a* and 4*b* are an enlarged plan and elevation respectively showing details of the attachment or locking means and the hinges, FIG. 5 is an elevation showing suitable inserts for the compartments, FIGS. 6*a* and 6*b* are diagrammatic plan and perspective views respectively of a modified container in its open and in its closed condition, and FIG. 7 is a diagrammatic elevation showing a stacked kit of containers and trays associated therewith.

Referring to FIGS. 1 to 3 of the drawings the container, which is of thermoplastics material such as that known as "ABS", is vacuum or pressure formed in a single operation from a sheet of said material of a thickness of 0.015 inch. The container comprises essentially, a rectangular body 1 having a first rectangular lid portion 2 and a second rectangular lid portion 3 integrally attached thereto along opposed edges of the body by a hinge 4 and 5 respectively. A cover portion 6, 7 respectively is integrally attached to each lid portion 2 and 3 also by way of hinges 8 and 9. The hinges are formed by suitably flexible regions of the integral body-lid structure and are discussed in more detail hereinafter.

Two storage compartments 1*a*, 1*b* are provided in the body separated by a wall 10 generally extending normal to the line of the hinges 4 and 5. The wall 10 is part-circular over part of its length whereby a rounded region 11 is provided in storage compartment 1*a*, of appropriate dimensions to accommodate a drinking cup snugly therein which, if packed with a beverage therein, would be provided with a sealed lid. The lid portions 2 and 3 also define storage compartments 2*a* and 3*a*, and these compartments, together with compartments 1*a*, and 1*b* of the body, are intended to accommodate different courses or parts of courses of a meal, e.g. lunch, such as salad, a meat course, a dessert and cheese, as well as condiments and cutlery which, conveniently, may be of plastic material. The main course is intended to be contained within compartment 1*b*, whilst one of the compartments 2*a*, 3*a* of the lid portions, which are of the same dimensions, may accommodate a small bottle of beverage for dispensing into an empty drinking cup.

The cover portions 6 and 7 are of substantially the same overall shape and size as their lid portions 2 and 3. Thus, each cover portion can be folded over on to its respective lid portion so as to close the compartments 2*a*, 3*a* which, when the lid portions are pivotted into the position shown in FIGS. 1 and 2 are compactly arranged over the body 1 and the various compartments are separted by the wall 10 and the cover portions 6 and 7. It will be appreciated that the upper edge of the wall 10 also acts to support the cover portions in their closed positions against the weight of articles or courses contained in the compartments 2*a* and 3*a*. With the cover portions and lid portions each pivotted to open positions, the various compartments are exposed in the same plane, thereby presenting a tray-like configuration; to facilitate this, the depth of the body 1 is made the same as that of the lid portions 2, 3. It will be seen that the walls of the lid and body portions are tapered to facilitate removal from the forming machine and to enable containers to be stacked within each other in their open condition. The walls are formed with vertical strengthening ribs 14.

In the closed condition as shown in FIGS. 1 and 2, the lid portions 2, 3 are locked or held in their closed positions on the body by co-operable male and female elements 15, 16 respectively positioned along marginal flanges 17 and 18 of the container at co-incident positions. In this embodiment two spaced pairs of elements are provided in each flange 17 and 18 for each lid portion. Similar locking means 19, 20 are provided for attaching each cover portion 6, 7 to its respective lid portion; one pair of elements is provided for each flange 16, 17 of the container and are so positioned that the elements provided in the flanges of each lid portion are located centrally between those for attaching the lid portion to the body 1. Such an arrangement of the pairs of elements is clearly shown in FIGS. 1 and 3.

Alternatively, male and female elements may be provided alternately at co-incident positions in said body, lid portions and cover portions, the arrangement being such that the cover portions are first folded onto their lid portions and the elements thereof connected, and these connected elements are in turn connected to their respective elements of the body when the lid portions are folded over the latter.

The male elements 19 of the cover portions 6, 7 are provided on tabs 21 one of which is extended beyond the width of flange 18 (see particularly FIGS. 1 and 2) whereby, with the container in the closed condition, the tabs may be pulled firstly to facilitate unlocking of the lid portions from the body and, thereafter, the cover portions from their lid portions, as shown in FIG. 3 the margin of the cover portions may be formed with raised male sections 22 shaped to seat closely into the mouth of the compartments 2*a*, 3*a* of their respective lid portions 2, 3 to enhance the locking and sealing effect of said cover portions.

Referring now to FIGS. 4*a* and 4*b*, in a preferred form, the locking or attachment means comprises pairs of co-operable elements comprising male element 15 and female element 16 both of circular cross-section. The female element 16 is of smaller diameter than the male element 15, which latter has two flats 23 in its wall at diametrically opposite positions as shown. The arrangement is such that when the elements are engaged and pressed together, because of the different diameters the flats tend to bow and thus allow a tight friction fit between the co-operating circular wall parts of the elements. It will be seen that in this embodiment the flats are orientated so that they are normal to the line of the hinges 4 and 5. However, it will be appreciated that this orientation is not critical and that lacking would be equally effective, e.g. with the flats parallel to said hinges. It will also be seen from these figures that the hinges 4, 5, 8 and 9 are each provided by a pair of spaced indentations in the form of grooves 24. In this embodiment the grooves have a radiused bottom of approximately ⅛ inch radius, a depth of approximately 3/16, inch and they are spaced approximately ⅛ inch apart, the adjacent walls of the grooves converging and being joined at a point 25. Thus, it has been found that the above dimensions provide an effective hinge for a vacuum or pressure formed plastics container having a nominal thickness of 0.015 inch although the bottom of the grooves will be thinner, the depth having a relationship with the thickness of the material. In particular, the portions on each side of the hinge can be folded flat on to each other and there is minimum distortion over the length of the hinge.

Referring now to FIG. 5, the compartment 1a may have an insert 26 associated therewith, the insert being of substantially the same shape as the compartment, but of smaller diameter, whereby it may nest in the compartment with a surrounding air gap 27. As shown, the insert is supported in its nested position by a marginal flange 28, which seats around the mouth of the compartment, and by support feet 29 formed in the bottom of the insert. At least some of the feet 29 may seat onto strengthening ribs 30 in the bottom of the compartment, and the insert may be provided with a hinged lid 31 arranged to fit into the insert opening. The surrounding air gap 27, which is preferably ⅛ inch or more, may be completely sealed by the provision of corresponding male and female raised sections provided respectively around the mouth of the compartment 1*a* and the flange 28 of the insert. Thus, an effective insulation space can be provided around the bottom and walls of the insert 26, the only heat paths being at the contact points of the feet 29. A substantially closed air space may be provided above the insert 26, with the lid portions 2 and 3 folded over the body portion 1 and locked thereto, by arranging that the plane of the lid 31 of the insert in its closed position is below the upper level of the opening of the insert as shown. Alternatively, as shown for the compartment 3*a*, the insert 24 may have a flat bottom and rest directly on strengthening ribs 30, whilst the upper end of the insert is formed with a bead 32 fitting within the mouth of the compartment.

Referring to FIGS. 6*a* and 6*b*, the cover portions 6 and 7 each have a further flap portion 33 hinged thereto, the hinge being preferably as described above with reference to FIGS. 4*a* and 4*b*. The flap portion 33 has an opening 34 punched out and that part of cover portion 6, 7 fitting into the mouth of its compartment 2*a*, 3*a* being cut out as shown by reference 22*a*; the arrangement is such that, whilst flap portion 33 can be folded to a vertical position, as shown in FIG. 6*b*, to provide a carrying handle for the closed container, the cut-out parts can be folded over independently to close off the compartments 2*a*, 3*a*, closure being retained by the raised sections 22.

Referring now to FIG. 7, the containers in their closed condition are shown stacked in tiers, each tier comprising two containers of substantially the form described hereinbefore, and preferably with no carrying flaps as described with reference to FIGS. 6*a* and 6*b*, and two trays 35, 36. Each tray is formed with a marginal wall 37 and is of dimentions sufficient to retain two closed containers snugly in a side-by-side relationship. As shown, the tray 35 provides a base for the containers, whilst the tray 36 is reversed and laid over the tops of the containers. The next tier with its base tray 35 is then mounted on top of tray 36 of the first tier and this is repeated for each subsequent tier. To facilitate stacking and to locate the tiers firmly, each tray is provided with co-operating keys and keyways 38, 39. Such a kit of stackable containers and trays provides a convenient arrangement for dispensing the containers, for example, they may be food containers to be served to delegates in their seats at a convention, conference or similar, the tray being used on the lap of each delegate as a base for an open food container. An open container is shown in position on the uppermost base tray 35.

Whilst the embodiment and modifications thereto have been described as a relatively cheaply produced container which may readily be thrown away after use, it will be appreciated that a durable version for repeated use at picnics, etc., may readily be formed of thicker plastics or other suitable material, perhaps with small modifications to the hinges and other details to cater for the extra thickness and/or less pliable nature of the particular material used.

What we claim is:

1. A packaging container comprising, in combination, a body having a pair of end walls, a pair of side walls and a bottom wall defining a storage compartment having an upper access opening, a pair of lid portions each having a pair of end walls, a pair of side walls and a bottom wall defining a storage compartment having an upper access opening, hinge means for interconnecting the upper edge portion of each of said body side walls with the upper edge portion of one of the side walls of each of said lid portions to position said lid portions on opposite sides of said body for presenting a tray-like configuration, a pair of substantially flat cover portions each having a pair of side edges and a pair of end edges, hinge means for interconnecting the upper edge portion of the other side wall on each of said lid portions with one of the side edges on each of said cover portions each of said cover portions being pivotably movable into closing relationship with the access opening of the storage compartment of the associated lid portion, said closed lid portions being subsequently pivotably movable into vertically stacked relationship with said body to position said cover portions in adjacent closing relationship with the access opening of said body storage compartment, and releasable locking means on the upper edge portions of said body, said lid portions, and said cover portions for retaining said body and said lid portions in said vertically stacked relationship.

2. A container according to claim 1, wherein both of said hinge means include an integrally formed strip having a pleated cross sectional shape.

3. A container according to claim 1, including a flap portion hingedly connected to the other side edge of each of said cover portions, said flap portions being disposed in an upwardly extending position in the vertically stacked relationship of said body and lid portions to provide carrying handles for said container.

4. A container according to claim 1, including at least one separating wall in said body storage compartment which extends normal to the line of the hinge means for said lid portions, said separating wall having an upper edge for supporting said cover portions against the weight of any contents in the storage compartments of said lid portions in the vertically stacked relationship of said body and lid portions.

5. A container according to claim 1, and further comprising a removable insert in said body storage compartment, said insert being of smaller dimensions then said compartment and having a flange for engagement with the upper edge portions of said body, raised boss means on said body bottom wall for supporting said insert on said bottom wall in spaced relationship therewith to define an air gap.

6. A container according to claim 1, wherein said releasable locking means includes sets of connectable male and female elements of generally circular cross-section at co-incident positions on said body and on said lid and cover portions.

* * * * *